United States Patent [19]

Sweet

[11] Patent Number: 4,669,733

[45] Date of Patent: Jun. 2, 1987

[54] PLAYING CARD HOLDER WITH TUFTED FLOCK LINER

[76] Inventor: Richard F. Sweet, 1454 Briarglen Ave., Westlake Village, Calif. 91361

[21] Appl. No.: 877,879

[22] Filed: Jun. 24, 1986

[51] Int. Cl.[4] ..... A63F 1/10

[52] U.S. Cl. ..... 273/150; 40/124.4

[58] Field of Search ..... 273/150; 40/124.2, 124.4

[56] References Cited

U.S. PATENT DOCUMENTS

| | | | |
|---|---|---|---|
| 1,286,780 | 12/1918 | Ribeyre | 273/150 |
| 1,416,447 | 5/1922 | Castles | 273/150 |
| 2,520,490 | 8/1950 | Boward | 273/150 |
| 2,634,132 | 4/1953 | Freedman | 273/150 |

FOREIGN PATENT DOCUMENTS

| | | | |
|---|---|---|---|
| 506052 | 10/1951 | Belgium | 273/150 |
| 731027 | 3/1966 | Canada | 273/150 |
| 301972 | 5/1917 | Fed. Rep. of Germany | 273/150 |
| 474455 | 9/1952 | Italy | 273/150 |

*Primary Examiner*—Anton O. Oechsle

*Attorney, Agent, or Firm*—Koppel & Harris

[57] ABSTRACT

A playing card holder is described in which two plates with diverging inner surfaces form a tapered slot which extends upward from a base section. The inner surface of each plate is lined with a layer of tufted flock material, which may be partially set into recesses in the opposed plate surfaces. The holder retains either a single card or a number of overlapping cards securely in place with a relatively high degree of static friction, and yet permits cards to be easily removed with a substantially lower dynamic friction without dislodging adjacent cards. The remote ends of the holder are provided with a compound curvature which protects the cards from casual visual observation by other players, while enhancing the ability of the player to easily and securely manipulate the cards.

11 Claims, 9 Drawing Figures

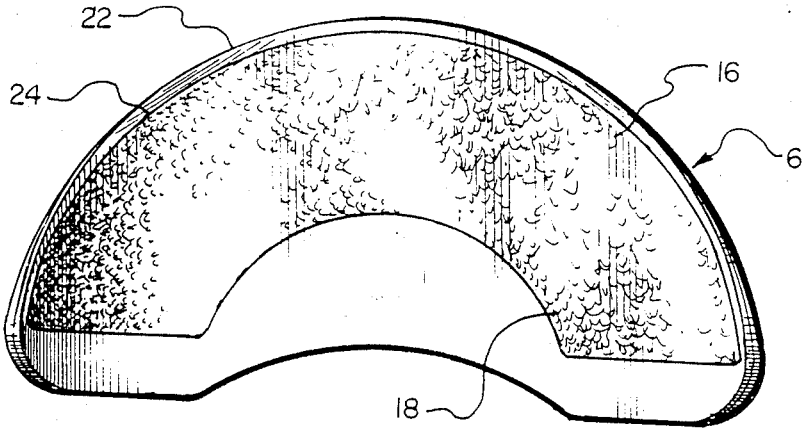
Fig. 5.
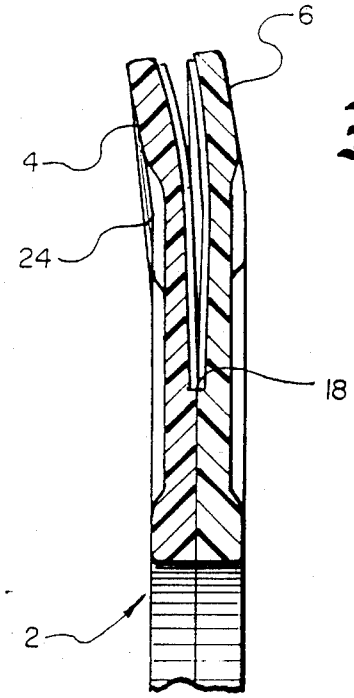
Fig. 3.
Fig. 7.
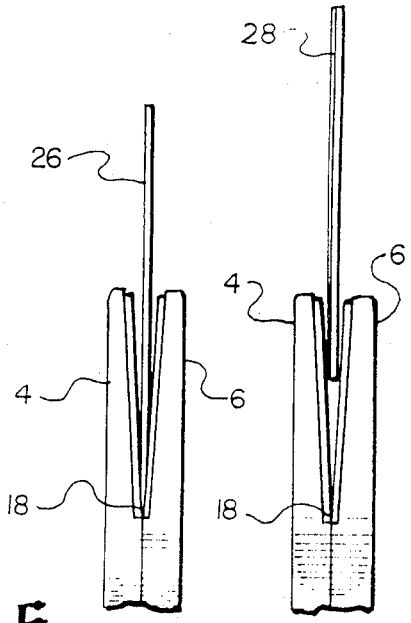
Fig. 6.

PLAYING CARD HOLDER WITH TUFTED FLOCK LINER

BACKGROUND OF THE INVENTION

1. Field of the Invention

This application is related to Ser. No. 795,933, filed Nov. 7, 1985, U.S. Pat. No. 4,630,824, and entitled "Playing Card Holder", and Ser. No. 828,630, filed Feb. 10, 1986, U.S. Pat. No. 4,625,966, and entitled "Playing Card Holder with Curvature", both by the present inventor. The invention relates to playing card holders, and more particularly to holders adapted to stand by themselves and to hold a number of overlapping playing cards at the same time.

2. Description of the Prior Art

Numerous attempts have been made to construct a playing card holder that can be used by either adults or children during a card game. An ideal playing card holder should be capable of easily accepting either single cards or a number of overlapping cards, should not allow the cards to slip either sideways or outwards but should allow individual cards to be removed without unintentionally pulling out or dislodging other cards, should display the cards so that they can be easily recognized and sorted by the user, and should be strong and durable in use. Unfortunately, no card holders are available which are known to satisfy all of these criteria. In addition, it would be desirable that the card holder simulate the action of a human hand as much as possible in holding cards. This could include features such as being able to hold the device comfortably in one's hand, being able to lay the cards face down or turn the holder completely upside down without the cards falling out of the holder, and being able to set the holder upright either vertically or tilted back at an angle, all with a single unitary movement.

SUMMARY OF THE INVENTION

The object of the present invention is to provide a novel and improved playing card holder which satifies all of the above requirements, and which is also simple in construction and easy to use.

The holder of the present invention includes a base from which first and second plates extend generally upward. The opposed surfaces of the plates are provided with respective layers of a tufted flock material facing the slot. The plates are spaced away from each other so that the tufted flock on each layer engages playing cards inserted into the slot. The tufted flock presents a greater static than dynamic friction to the outward movement of cards, and holds the cards securely in place while allowing them to be easily removed when desired.

In the preferred embodiment, the plates have opposed surfaces which diverge from each other away from the base, within the range of about 1°-8° and preferably 3°-5°, to form a tapered slot within which playing cards are placed. The base includes a stand which is adapted to hold the device either vertically, or in a generally upright position at an angle tilted back from vertical. The plate surfaces include recesses of slightly lesser depth than the thickness of the tufted flock layers, allowing the layers to be disposed within the recesses but still contact the playing cards. The base forms an arcuate bottom stop for the slot that prevents cards from being inserted too far, and maintains a uniform card height. The plates are formed from a stiff material that provides substantially fixed slot dimensions.

In one embodiment the plates are formed symmetrically about a centerline, with the plate sections remote from the centerline and on either side thereof generally curved about the centerline. The upper portions of the curved plate sections are provided with a compound curvature which additionally helps to hold the cards statically, while allowing them to be easily removed.

Further features and advantages of the invention will be apparent to those skilled in the art from the following detailed description of preferred embodiments, taken together with the accompanying drawings, in which:

DESCRIPTION OF THE DRAWINGS

FIGS. 2 and 3 are sectional views taken along the lines 2—2 and 3—3 of FIG. 1, respectively;

FIG. 5 is an elevational view of the inner face of one of the plates which form the holder;

FIGS. 6 and 7 are enlarged fragmentary sectional views of the playing card holder respectively showing relatively small and large numbers of playing cards held in the device.

DETAILED DESCRIPTION OF PREFERRED EMBODIMENTS

Figure 1:
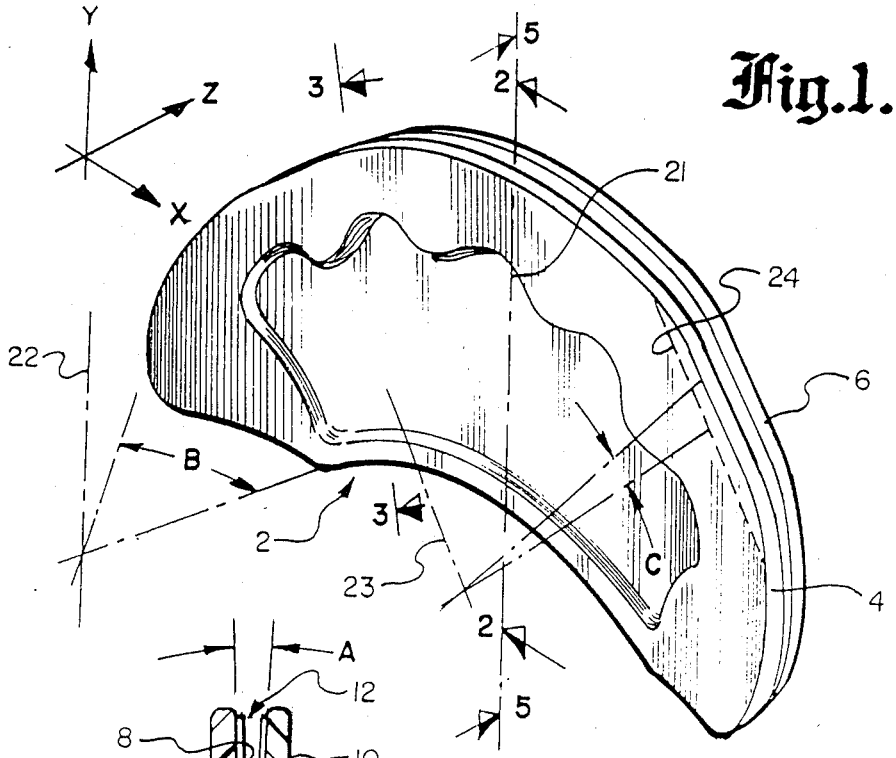
FIG. 1 is a perspective view of the playing card holder of the present invention.

A perspective view of a playing card holder constructed in accordance with the present invention is provided in FIG. 1. The holder includes a lower base section 2 from which a pair of plates 4 and 6 extend generally upward, the base section being formed integrally with the plates. The holder is preferably made from a stiff plastic material such as ABS (acrylonitrile butadiene styrene), PVC, polyethylene, nylon, polypropylene, styrene, etc. It is preferably formed with an arcuate upper surface so that playing cards may be evenly distributed around the upper portion of the holder.

Figure 2:
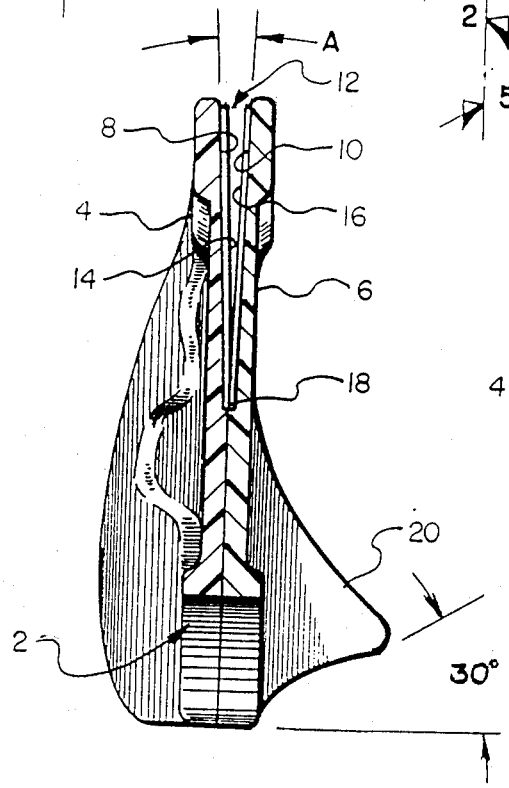

As best shown in FIGS. 2 and 3, the two plates 4 and 6 have mutually opposed inner surfaces 8 and 10 which diverge away from each other with increasing distance from the upper edge of base section 2. The two plates thus form a tapered slot 12 within which playing cards may be secured. The angle of divergence A between the two plates is within the approximate range of 1°-8°, and preferably is about 3°-5°.

The plates 4 and 6 include arcuate recesses in their inner surfaces within which respective layers 14, 16 of a material having a tufted flock facing the slot are partially disposed. The thicknesses of the tufted flock layers are somewhat greater than the depths of their respective recesses, so that the tufted flock material extends beyond the inner surfaces of the plates to contact the playing cards. Alternately, the recesses could be deleted and the tufted flock layers extended fully into the slot, although this would present a greater impediment to the insertion of cards. The characteristics of the tufted flock material, which are crucial to the present invention, are discussed in further detail below.

The plates 4 and 6 come into near or actual contact with each other at the bottoms of their respective recesses. The lower end of recess 8 is extended in depth to form a lip 18 which abuts against plate 6 at the lower end of recess 10, thereby providing a stop for slot 12 along an arcuate path. Viewed another way, stop 18 coincides with the upper end of base 2.

The bottom of the base is squared off, allowing the card holder to be stood up vertically during play, and includes a central curvature that makes the device easier to hold by hand. The base also includes a pair of legs 20 which extend out from one side to form a stand for supporting the card holder in a generally upright position. The legs are spaced widely apart so that the card holder can be hand-held without interference from the legs. The undersides of legs 20 extend up from horizontal by an angle of approximately 30°, thus permitting the card holder to be tilted back at an approximately 30° angle to vertical when in use. This provides better visibility of the cards for a player seated at a normal card table.

Figure 4:
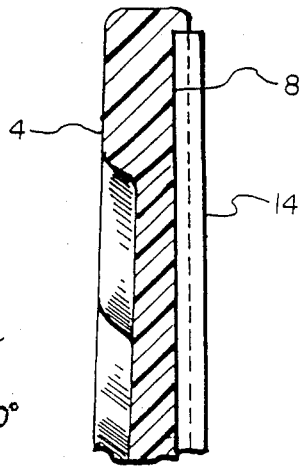
FIG. 4 is an enlarged fragmentary sectional view showing a layer of tufted flock material on the holder used for contacting the playing cards.

An enlarged view of the upper portion of plate 4 is shown in FIG. 4. It can be seen that the recess 8 begins slightly below the top of the plate. It has a depth of about 0.017 inch (0.43 mm), which is shallower than the thickness of the tufted flock material 14. The recess is deep enough to prevent the material from extending out from the plates so far as to interfere with the insertion of cards into the holder, but is shallow enough to ensure that te playing cards make a good contact with the material.

The playing card holder described thus far may be manufactured in two molded sections, each section including a respective one of the plates and a portion of the base. Various arrangements may be used to hold the sections securely together at the base. For example, the holder can be made from relatively stiff plastics such as polypropylene and polyethylene with snaps provided along the lower portion of one section and mated with sockets in the other section. Alternately, the holder could be formed from certain types of rigid plastics such as ABS which can be chemically or ultrasonically bonded together. The holder could also be formed from a single mold.

It is desirable that some means be provided to give extra assurance that a player's cards cannot be casually observed by other players. To this end the lateral extremities of the card holder are curved inwardly toward the player so that the cards will be similarly curved, thus placing their faces at a greater angle to the other players. However, simply curving the card holder has been found to interfere with the ease with which cards may be inserted and removed from the holder if the spacing of the slot between the plates is such as to still securely hold the cards in place. The holder includes a unique design which accomplishes the desired extra degree of visual security, and yet permits cards to be inserted and removed with substantially no more difficulty than with a perfectly flat holder.

For purposes of description, it will be convenient to reference the card holder to a three-dimensional space which is oriented according to x, y and z axes, as indicated in FIG. 1. The base of the card holder, which essentially extends along a diameter of the semi-circular plates, is defined as lying generally in the x-direction, with the semi-circular arcuate portions of the plates generally disposed in the x, y plane and generally symmetrical about a y-direction centerline 21. It will be noted that centerline 21 coincides with cutline 2—2 for FIG. 2.

The lateral portions of the plates which are remote from centerline 21 are curved along a generally arcuate locus in the z-direction about an axis 22 which lies generally in the y-direction, thus increasing the visual security of cards placed in the holder. While details of the z-axis curvature are described herein only with respect to the right hand side of the card holder, a symmetrical curvature should be provided for the left hand side of the holder. The z-axis curvature preferably extends generally along an arc B in the approximate range of 25°–50°, and preferably in the range of about 35°–40°. It occupies approximately 15%–30% and preferably about 20%–25% of the length of the holder's base diameter on either side of the centerline.

While the holder described thus far is an improvement over the prior art and provides additional visual security, in use the playing cards are generally inserted and removed from the holder somewhat less easily than if the plates were flat. It has been discovered that the addition of a further z-axis curvature along a different axis for only a portion of the lateral plate sections will preserve the added degree of security, and yet render the manipulation of cards within the holder virtually as convenient as with a flat holder. This additional curvature involves the upper portions of the remote plate sections, which are further curved in the z-direction about an axis 23 that lies generally in the x-y plane at a substantial angle to both the x and y axes. The additional curvature preferably extends generally along an arc C in the approximate range of 20°–45°, and preferably in the range of about 30°–35°. The bottom limit of the additional curvature is indicated by dashed line 24 in FIG. 1. Projecting the limits of the additional curvature down to the base of the holder, it preferably extends for approximately 10%–25%, and preferably about 30%–15% of the length of the base on either side of the centerline, and is spaced somewhat inwardly from the lateral end of the holder. The axis of curvature 23 for this additional z-direction curvature preferably lies in the x-y plane within the approximate range of 4°–8° to the x-axis.

Referring now to FIG. 5, the inner face of section 6 is shown; the inner face of section 4 is substantially similar, but with a complementary z-direction curvature. The upper outer periphery 22 of the section, the upper edge 24 of the recess which holds the tufted flock material and the stop 18 which forms the lower edge of the recess all describe generally mutually concentric arcs. This results in a protrusion of all the cards in the holder a substantially uniform distace above the holder.

A relatively small number of cards 26 are illustrated as being secured by the holder in FIG. 6. Since the opposed layers of tufted flock material are slightly separated at their lower ends, the cards bottom out against stop 18. It is a distinct advantage of the invention that it will accommodate a considerably larger number of cards and still hold them with a uniform protrusion above the holder. This is important for games in which the players must be able to hold numerous cards, such as Contract Bridge, Crazy Eights and Old Maid. FIG. 7 illustrates how the holder accommodates a relatively large number of cards 28. Since the thickness of the cards taken together is greater than the spacing between the opposed sections at bottom stop 18, the cards are inserted only partially into the slot. Due to the slot taper, the cards can be inserted to a depth above stop 18 at which they are securely held in place, and still extend above the holder by approximately equal amounts.

Figure 8:
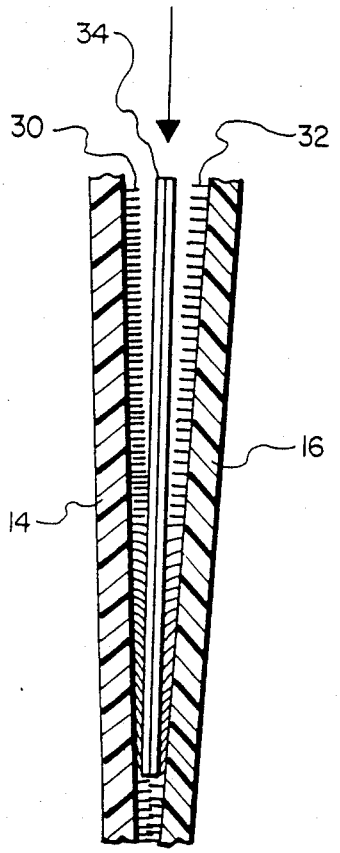
FIGS. 8 and 9 are enlarged fragmentary sectional views of the playing card holder respectively illustrating the static holding action and the dynamic releasing action of the tufted flock material.
Figure 9:
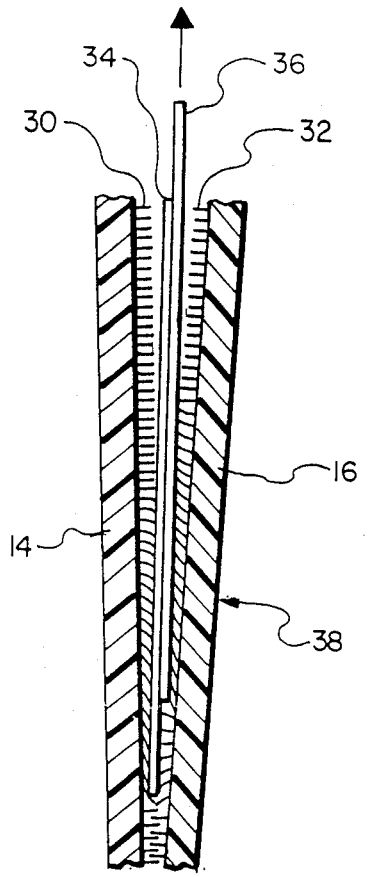

The critical action of the tufted flock material in securely holding the cards in place, and yet allowing individual cards to be conveniently removed from the holder without dislodging adjacent cards, is illustrated in FIGS. 8 and 9. The tufted flock layers 14 and 16 are shown in isolation from their supporting plates. The two layers 14, 16 each have a matrix of tufts 30, 32, respectively, extending into the tapered slot; the tuft dimensions and spacing are exaggerated in the figures. The tufts consist of fibers, threads, hairs or the like of wool, cotton, nylon, etc. that extend out from the plane of the material, either singly or in bunches, and are distributed over the surface of the material. The flock has a "grainy" feel or nap; the outer ends of the flock can be moved from side to side by lateral finger pressure without slipping the finger against the material. A tufted flock is to be distinguished from felt, which is a homogenous cloth made by rolling and pressing together wool, hair or fur to give a smooth surface. Felt will not provide the combination of positive card holding ability, yet easy release, that applicant has discovered can be achieved with tufted flock material.

As illustrated in FIG. 8, the tufts engage a set of playing cards 34 that have been inserted into the holder so as to establish a static friction against removal of the cards which is substantially greater than the dynamic friction of the tufts against a card which is being pulled outward from the holder. As shown in FIG. 8, the cards are inserted down into the holder until they are held in place by the lateral pressure of the tufts on either side. At this point the ends of the tufts in contact with the cards have generally been deflected downward by the inward movement of the cards, thus increasing the static friction presented against any movement of the cards in the opposite direction. This static friction effectively keeps the cards in place and holds them against any unintended lateral slippage or outward movement; the holder can even be turned completely upside down without the cards dislodging.

In FIG. 9 one of the cards 36 is shown in the process of being removed from the holder by the player. Once the initial static friction has been overcome by the player simply pulling the card up with a normal motion, continued upward movement causes the tufts in contact with the card to deflect in the direction of movement, as indicated in area 38. This results in a dynamic friction that is substantially lower than the static friction which held the card in place against unintentional movement, but is still sufficient to give the player a positive "feel" as the card is pulled out.

Various types of tufted flock materials, such as Rubbermaid Contact Brand Cushion-All Flocked Covering Material, are suitable for the present card holder application. This is a stick-on composite laminate material which is provided with a removeable paper backing and is approximately 0.022 inch (0.559 mm.) thick after the backing has been removed. It can simply be cut to conform to the shape of the recesses in the plates 4 and 6, and stuck on within the recesses after the paper backing has been removed. Other tufted flock materials that could be used include "Rich Vel" or "Fi-Vel" from C. W. Fifield Company of Hingham, Mass., or "Cellusuede Flock Coated Paper" from Cellusued Products, Inc. of Rockford, Ill. Simple cushioning materials such as felt or rubber do not give as positive results as the tufted flock materials discussed above.

In operation, the playing card holder is set upright and cards are inserted into the slot 12 between the two plates. Either one or a number of overlapping cards can be securely held in place, and yet easily removed. It is a distinct advantage of this construction that, when one card is removed, adjacent cards tend to stay in place and are not pulled out along with the moving card. The holder also allows cards to be pulled out, re-inserted and rearranged continually without moving adjacent cards or substantially disrupting the uniform card height above the holder, while al the time securing the cards from observation by other players.

Another advantage is that the combination of the plate curvature and tufted flock lining produces an enhanced holding action on cards that are placed towards the sides of the holder, rather than near the top. Cards positioned near the holder extremities might ordinarily be expected to slip somewhat laterally, but the present holder has been found to securely capture such cards in place and yet still permit easy insertion and removal.

Numerous modifications and alternate embodiments of the invention will occur to those skilled in the art. Also, while the invention has been described in terms of a playing card holder, it is equally capable of holding slips of paper, notecards and the like. Accordingly, it is intended that the invention be limited only in terms of the appended claims.

I claim:

1. A holder for playing cards, comprising:

a base, first and second plates having generally arcuate outer peripheries and extending generally upward from the base, the plates having opposed surfaces which mutually diverge from each other away from the base to form a tapered slot with an angular divergence within the approximate range of about 1°–8°, respective layers of material on the inner surface of each plate having a tufted flock facing the slot, said plates being spaced apart from each other so that the tufted flock on each layer engages playing cards inserted into the slot, and means for holding the base in a generally upright position.

2. The playing card holder of claim 1, wherein the opposed surfaces of said plates mutually diverge from each other with an angular divergence within the approximate range of about 3°–5°.

3. The playing card holder of claim 1, the opposed surfaces of said plates including recesses of lesser depths than the thicknesses of said layers of tufted flock material, said layers being disposed in said recesses.

4. The playing card holder of claim 1, said plates being formed from a stiff material which accommodates different numbers of cards within the slot without any substantial movement of the plates.

5. The playing card holder of claim 1, said holding means comprising a stand for supporting the card holder in a generally upright position at a non-zero angle to vertical.

6. The playing card holder of claim 5, said holding means comprising a squared section on the bottom of the holder to enable the holder to be stood up substantially vertically.

7. The playing card holder of claim 1, said holder being formed from two members, each member including a respective portion of the base and a respective plate extending therefrom, said base portions being joined together with their respective plates mutually diverging as described.

8. The playing card holder of claim 1, wherein the plates are formed in a three-dimensional space oriented according to x, y and z axes, both plates being generally disposed in the x-y plane and generally symmetrical about a centerline in the y-direction, the plate sections remote from the centerline and on either side thereof being generally curved in the z-direction about the centerline.

9. The playing card holder of claim 8, wherein the upper portions of the plate sections remote from the centerline are further curved generally in the z-direction about an axis which lies generally in the x-y plane at substantial angles to both the x and y axes.

10. A holder for playing cards, comprising:

a base, first and second plates extending generally upward from the base, said plates including mutually opposed surfaces forming a slot therebetween for receiving and releasably securing playing cards, and respective layers of material on the opposed plate surfaces adapted to contact playing cards inserted into the slot, each layer having a tufted flock facing the slot, said plates being spaced apart from each other so that the tufted flock on each layer engages playing cards inserted into the slot.

11. The playing card holder of claim 10, said plates being formed from a stiff material and forming a slot of substantially fixed dimensions.

* * * * *